US012038256B2

(12) United States Patent
Planck

(10) Patent No.: US 12,038,256 B2
(45) Date of Patent: Jul. 16, 2024

(54) LOW PROFILE RAIL MOUNT FOR FIREARM

(71) Applicant: Crimson Trace Corporation, Wilsonville, OR (US)

(72) Inventor: William A. Planck, Columbia, MO (US)

(73) Assignee: Crimson Trace Corporation, Columbia, MO (US)

( * ) Notice: Subject to any disclaimer, the term of this patent is extended or adjusted under 35 U.S.C. 154(b) by 0 days.

(21) Appl. No.: 17/032,493

(22) Filed: Sep. 25, 2020

(65) Prior Publication Data

US 2021/0088310 A1 Mar. 25, 2021

Related U.S. Application Data

(60) Provisional application No. 62/905,902, filed on Sep. 25, 2019.

(51) Int. Cl.
*F41G 11/00* (2006.01)

(52) U.S. Cl.
CPC ..... *F41G 11/003* (2013.01)

(58) Field of Classification Search
CPC ..... F41G 11/003
See application file for complete search history.

(56) References Cited

U.S. PATENT DOCUMENTS 3,979,848 A * 9/1976 Ackerman, Jr. ..... F41G 1/26 42/126
5,941,489 A * 8/1999 Fanelli ..... F41G 1/16 42/114
6,139,237 A * 10/2000 Nagayama ..... F16B 37/048 411/181
6,418,657 B1 * 7/2002 Brown ..... F41G 1/26 42/126
6,606,813 B1 * 8/2003 Squire ..... F41C 27/00 248/201
6,725,594 B2 * 4/2004 Hines ..... F41C 23/16 42/124
6,782,652 B1 * 8/2004 Erickson ..... F41A 35/02 42/124
7,562,483 B2 * 7/2009 Hines ..... F41G 11/003 42/71.01
7,845,105 B1 * 12/2010 Cahill ..... F41C 27/00 42/72
7,856,749 B2 * 12/2010 Fitzpatrick ..... F41A 35/02 42/96
8,141,286 B1 * 3/2012 Saur ..... F41C 23/08 42/74
D691,235 S * 10/2013 Fitzpatrick ..... D22/108
8,650,793 B1 * 2/2014 Mendez ..... F41G 11/003 42/90
D704,789 S * 5/2014 Fitzpatrick ..... D22/108
8,875,434 B2 * 11/2014 Michal ..... F41C 27/00 42/96

(Continued)

*Primary Examiner* — Michelle Clement
(74) *Attorney, Agent, or Firm* — Stinson LLP

(57) ABSTRACT

A low profile rail mounting system, comprises an adaptor for mounting an accessory on a firearm rail. The adaptor can include flexible material such that the adaptor can be snapped into position to mount the adaptor on the firearm rail. The adaptor includes opposite grooves that receive the firearm rail to maintain the adaptor on the rail.

16 Claims, 7 Drawing Sheets

(56) References Cited

U.S. PATENT DOCUMENTS 8,935,874 B2 * 1/2015 Troy ..... F41G 11/003 42/96
9,115,955 B2 * 8/2015 Barnhart ..... F41C 23/16
9,222,749 B1 * 12/2015 Nakayama ..... F41C 23/16
9,222,756 B1 * 12/2015 Battaglia ..... F41G 11/003
9,395,138 B2 * 7/2016 Troy, Jr. ..... F41C 27/00
9,568,282 B1 * 2/2017 Schorman ..... G03B 17/561
9,677,854 B1 * 6/2017 Tran ..... F41G 11/003
9,702,655 B2 * 7/2017 Nakayama ..... F41C 23/16
9,772,161 B1 * 9/2017 Cheng ..... F41C 23/16
9,851,176 B2 * 12/2017 Flagler ..... F41C 23/16
9,964,380 B1 * 5/2018 Oglesby ..... F41C 23/16
9,989,328 B2 * 6/2018 Ding ..... F41A 35/02
10,001,344 B1 * 6/2018 ALford ..... F41G 11/003
10,495,407 B1 * 12/2019 Shelton ..... F41C 23/16
10,788,292 B2 * 9/2020 Alldredge ..... F41G 11/003
2001/0022044 A1 * 9/2001 Spinner ..... F41G 11/003 42/124
2003/0106252 A1 * 6/2003 Hines ..... F41G 11/003 42/90
2004/0000083 A1 * 1/2004 Grant, Jr. ..... F41G 11/003 42/112
2004/0064994 A1 * 4/2004 Luke ..... F41C 23/16 42/85
2004/0226212 A1 * 11/2004 Shiloni ..... F41C 23/16 42/96
2006/0075672 A1 * 4/2006 Romer ..... F41A 35/02 42/10
2007/0006512 A1 * 1/2007 Williams ..... F41G 11/003 42/124
2008/0092423 A1 * 4/2008 Keng ..... F41G 11/003 42/111
2009/0241397 A1 * 10/2009 Fitzpatrick ..... F41A 35/02 42/90
2010/0236124 A1 * 9/2010 Troy ..... F41C 23/16 42/90
2011/0099873 A1 * 5/2011 Bentley ..... F41C 23/16 42/71.01
2011/0162251 A1 * 7/2011 Houde-Walter ..... F41G 11/003 42/146
2012/0085013 A1 * 4/2012 Cahill ..... F41C 27/00 42/96
2012/0266514 A1 * 10/2012 Michal ..... F41C 27/00 42/90
2013/0061506 A1 * 3/2013 Atkinson ..... F41G 11/003 42/90
2013/0181021 A1 * 7/2013 Yarbrough ..... F41C 33/0236 224/244
2013/0318852 A1 * 12/2013 Teetzel ..... F41G 11/003 42/90
2013/0326925 A1 * 12/2013 Power ..... F41A 35/02 42/71.01
2014/0109457 A1 * 4/2014 Speroni ..... F41G 1/35 42/114
2014/0325888 A1 * 11/2014 Barnhart ..... A47G 1/06 42/71.01
2014/0360077 A1 * 12/2014 Miller ..... F41C 27/00 42/84
2014/0373329 A1 * 12/2014 Volfson ..... F41G 11/003 29/428
2016/0091272 A1 * 3/2016 Hines ..... F41A 35/00 42/90
2016/0091278 A1 * 3/2016 Jen ..... F41C 23/16 42/90
2016/0169610 A1 * 6/2016 Hines ..... F41C 23/16 42/90
2016/0209175 A1 * 7/2016 Sharron ..... F41G 11/003
2016/0211095 A1 * 7/2016 Zimmer ..... F41C 27/00
2017/0191801 A1 * 7/2017 Tresserras Torre ... F41G 11/002
2017/0234646 A1 * 8/2017 Flagler ..... F41G 11/003 42/71.01
2017/0234653 A1 * 8/2017 Maughn ..... F41G 11/003 42/124
2017/0299337 A1 * 10/2017 Ding ..... F41G 11/004
2018/0053607 A1 * 2/2018 McCauley ..... F41G 11/003
2018/0094904 A1 * 4/2018 Greenwood ..... F41G 11/003
2018/0112952 A1 * 4/2018 Kincel ..... F41G 11/003
2018/0142991 A1 * 5/2018 Rogers ..... F41G 11/004
2018/0164078 A1 * 6/2018 Hancosky ..... F41G 11/004
2018/0216911 A1 * 8/2018 Jen ..... F41G 11/003
2018/0364009 A1 * 12/2018 Hancosky ..... F41G 1/35
2019/0242677 A1 * 8/2019 Ding ..... F41G 11/003
2019/0323541 A1 * 10/2019 Windfeldt ..... F41G 11/001
2020/0232601 A1 * 7/2020 Chavez ..... F16M 13/04
2021/0054964 A1 * 2/2021 Chen ..... F16M 13/022
2021/0055078 A1 * 2/2021 Roberson ..... F41G 1/387
2021/0088310 A1 * 3/2021 Planck ..... F41G 11/003
2021/0108891 A1 * 4/2021 Ma ..... F41G 11/003
2021/0254930 A1 * 8/2021 Pischke ..... F41C 27/00
2021/0302123 A1 * 9/2021 Mayberry ..... F41G 1/00

* cited by examiner

LOW PROFILE RAIL MOUNT FOR FIREARM

FIELD

The present disclosure generally relates to mounting hardware for attaching an accessory to a firearm rail, such as a Picatinny® or M-Lok® rail, and in particular, a low profile mounting system that reduces bulk when mounting an accessory to a firearm.

BACKGROUND

Rail systems on firearms are mounting brackets (usually made of strips of metal or polymer) on the gun's receiver, handguard, or fore-end stock to allow attachment of accessories such as optical sights, tactical lights, laser sight and the like. Rail systems usually are based on the handguard of a weapon and/or the upper receiver. Common types of rail systems for firearms are the dovetail rail, the Weaver rail, the Picatinny® rail (also known as the MIL-STD-1913 or STANAG 2324 rail), and the Magpul M-Lok®. One of the problems with mounting to rail systems is that the mounting hardware creates added bulk.

SUMMARY

In one aspect, a low profile rail mounting system comprises an adaptor comprising flexible material permitting the adaptor to be snapped into position to mount the adaptor on a firearm rail. The adaptor includes an upper adaptor section configured to seat on the firearm rail. The adaptor includes a first wing section and a second wing section each extending distally from opposite sides of the upper adaptor section and extending over the firearm rail when mounted. The adaptor includes a first foot section and a second foot section on a distal end of the respective first wing section and second wing section. The first foot section and first wing section form a first groove, and the second foot section and second wing section form a second groove to secure the adaptor to the firearm rail when mounted.

Other objects and features of the present disclosure will be in part apparent and in part pointed out herein.

BRIEF DESCRIPTION OF THE DRAWINGS

Corresponding reference characters indicate corresponding parts throughout the drawings.

DETAILED DESCRIPTION

Figure 1:
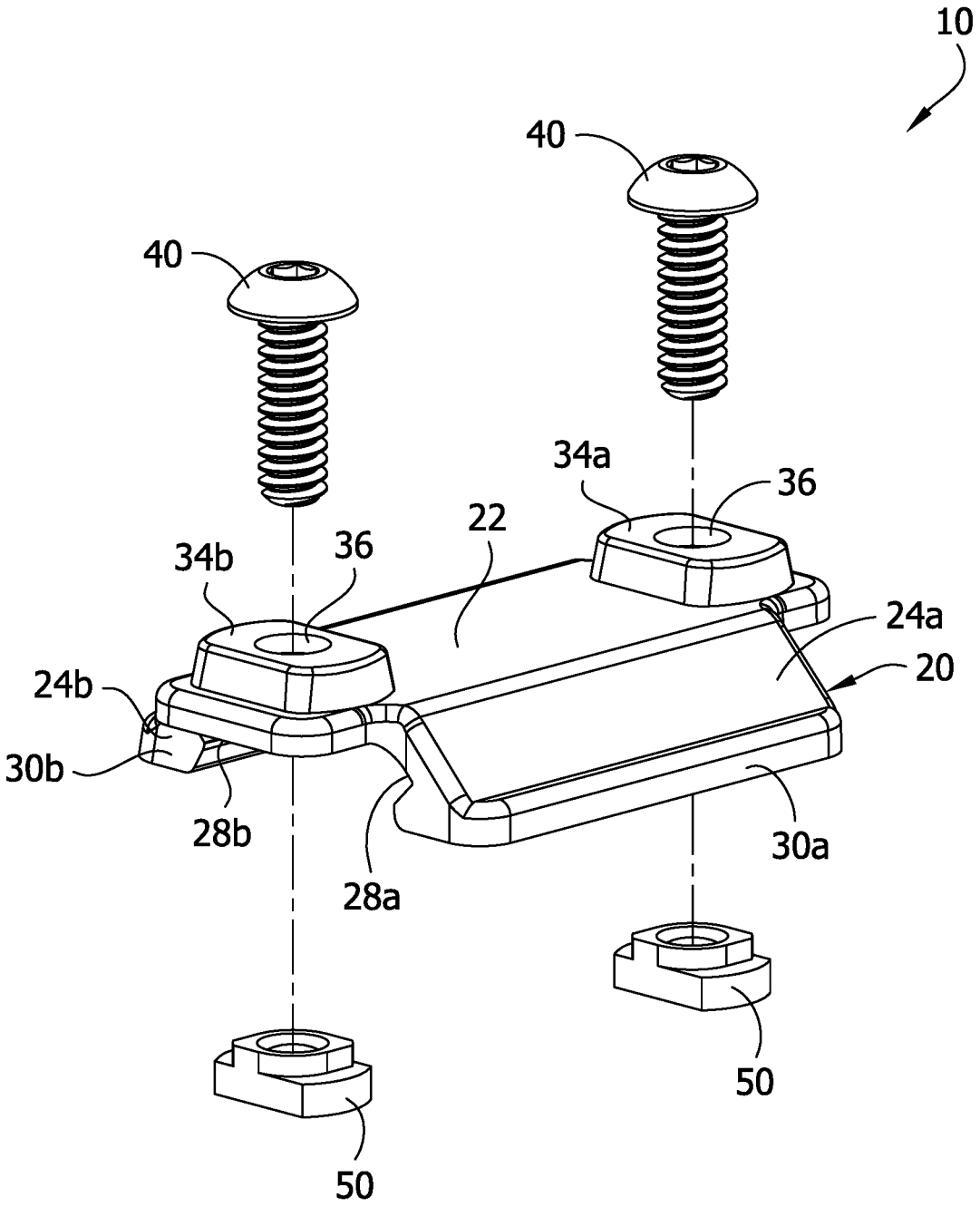
FIG. 1 is a top perspective of a low profile rail mounting system.

Disclosed herein is a low profile rail mounting system for mounting to a firearm rail, such as a Picatinny® or M-Lok® rail. The disclosed low profile rail mounting system allows for easy mounting of firearm accessories, such as scopes, laser sites, and the like, to the rail and hence the firearm to which the rail mounting system is attached. The low profile rail mounting system includes an adaptor (e.g., adaptor plate) that comprises a flexible material permitting the adaptor to be snapped into position. For example, the flexible material may include plastic, fiber reinforced plastic, fiber reinforced polymer, and/or polymer material. The adaptor may be composed entirely of the flexible material. Alternatively, the adaptor may include non-flexible material in combination with the flexible material (e.g., providing relatively rigid portions and relatively flexible portions). The adaptor incudes an upper section configured to seat on a firearm rail, making contact with the upper or top surface(s) of the rail. For example, the adaptor can straddle the rail transverse to the long axis (longitudinal axis) of the rail or firearm. The adaptor extends longitudinally along the top of the rail, for example over one or more cross slots of the firearm rail. The adaptor plate includes a first wing section and a second wing section each extending distally from opposite sides of the upper section and extending over and at least partially encircling the sides of the firearm rail when mounted. Foot sections are connected to respective wing sections. The first foot section and first wing section form a first groove (e.g., v-groove) on what would be considered the interior of the adaptor. The second wing section forms a second groove (e.g., v-groove) opposite the first groove on the interior of the adaptor. The first groove and the second groove work together on opposite sides of the rail system to secure the adaptor to the firearm rail when mounted thereon, for example, by capturing the respective sides of the rail. The sides of the rail may be triangular portions of the rail that protrude laterally. The adaptor plate includes one or more risers on the upper section, for example, to place an accessory at a proper height relative to the rail, barrel, and/or receiver of the firearm. The adaptor includes one or more alignment bosses on a bottom surface of the upper section (considered the inside of the adaptor plate) that are configured to align with and be received in cross slots on the firearm rail when mounted. The alignment bosses work to align the adaptor and hence the accessory longitudinally with respect to the rail and/or firearm. The adaptor first foot section and second foot section each include a tapered section opposite the grooves. The tapered sections are configured to provide an interference taper fit between the adapter and firearm accessory such that when the adaptor and the firearm accessory are connected, the grooves are biased inward to provide lateral clamping force between the firearm accessory and the firearm rail. Desirably, the adaptor protrudes less than ¾ inch, more desirably less than ⅝ inch, and more desirably less than ½ inch, from a surface of the rail on which the upper section is seated when installed.

The low profile rail mounting system can include one or more fasteners, such as screws, bolts and the like, that can secure a firearm accessory to the adaptor, for example when mounted to the rail system. The one or more fasteners can further secure the adaptor to the firearm rail when mounted. In some examples, the one or more fasteners are of sufficient length to extend through both the accessory and the adaptor plate to secure both the accessory and the adaptor plate to the firearm rail. The low profile rail mounting system further includes one or more nuts, such as t-nuts, to secure the one or more fasteners that are secured to the underside of the adaptor.

The low profile rail mounting system can include a firearm accessory, such as laser site, and/or a scope. The low profile rail mounting system can include a rail system, such as a Picatinny® rail system or a M-Lok® rail system.

Referring now to FIGS. 1-6, a low profile rail mounting system 10 includes an adaptor 20, fasteners 40, and T-nuts 50. The adaptor 20 (e.g., "adaptor plate") includes an upper section 22, a first wing section 24*a*, and a second wing section 24*b* that extend from the upper section 22, for example to at least partially envelop a portion of the rail. The adaptor 20 can further include risers 34*a* and 34*b* which include openings 36 to accommodate fasteners 40. The adaptor 20 further includes a first foot section 30*a* and a second foot section 30*b* on the distal ends of the respective first wing section 24*a* and second wing section 24*b*. Together, the first foot section 30*a* and first wing section 24*a* form a first groove 28*a* (e.g., "v-groove"), and the second foot section and 30*b* second wing section 24*b* form a second groove 28*b* (e.g., "v-groove") to secure the adaptor 20 to a firearm rail. For example, the adaptor may clamp or pinch the rail between the two grooves 28*a* and 28*b*.

Figure 2:
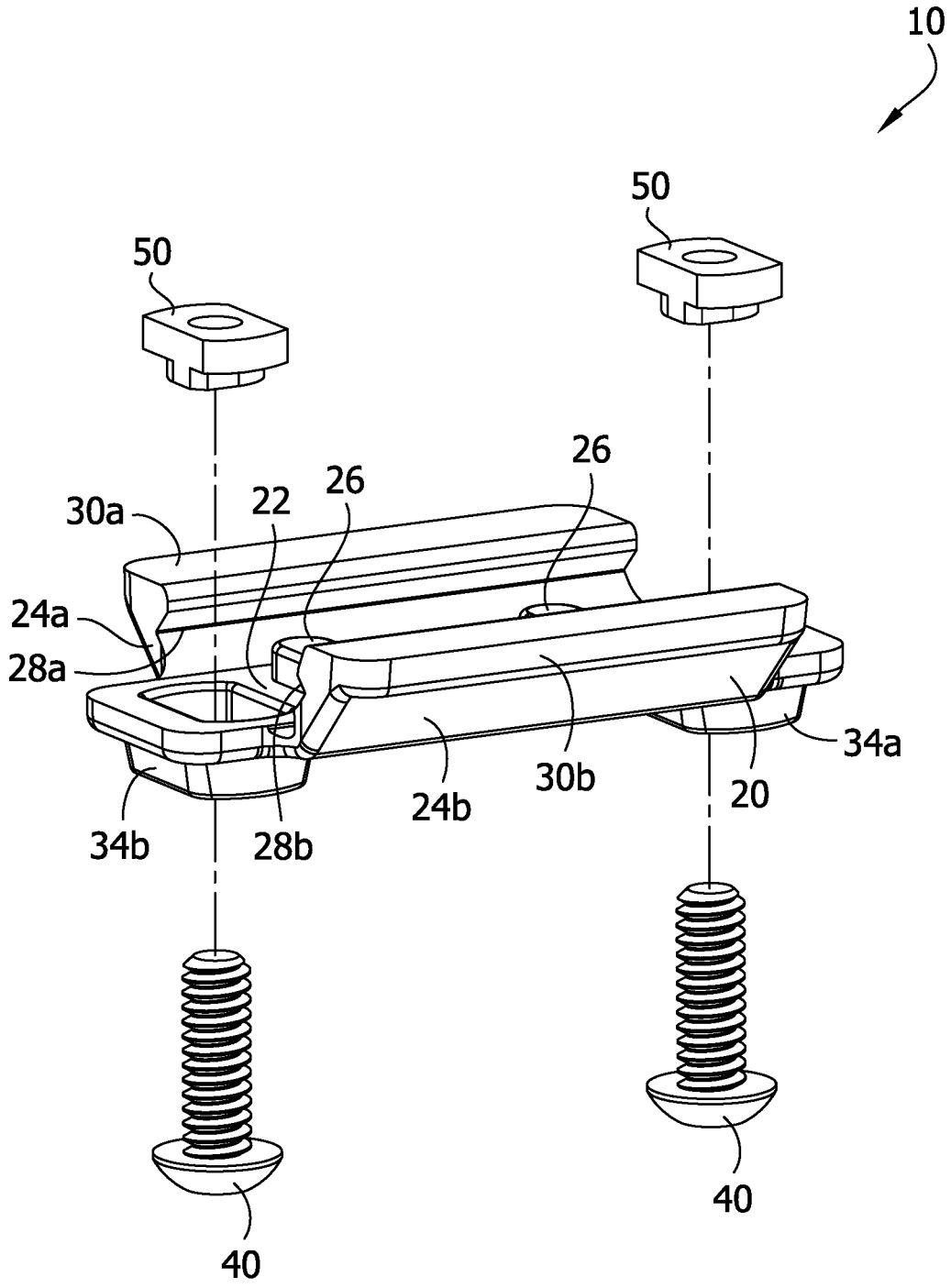
FIG. 2 is a bottom perspective of the low profile rail mounting system shown in FIG. 1.

With reference to FIG. 2, the adaptor 20 can further include alignment bosses 26 on a lower surface of the upper section 22. The alignment bosses 26 are spaced and configured to align with and be received in cross slots of the firearm rail when mounted.

Figure 3:
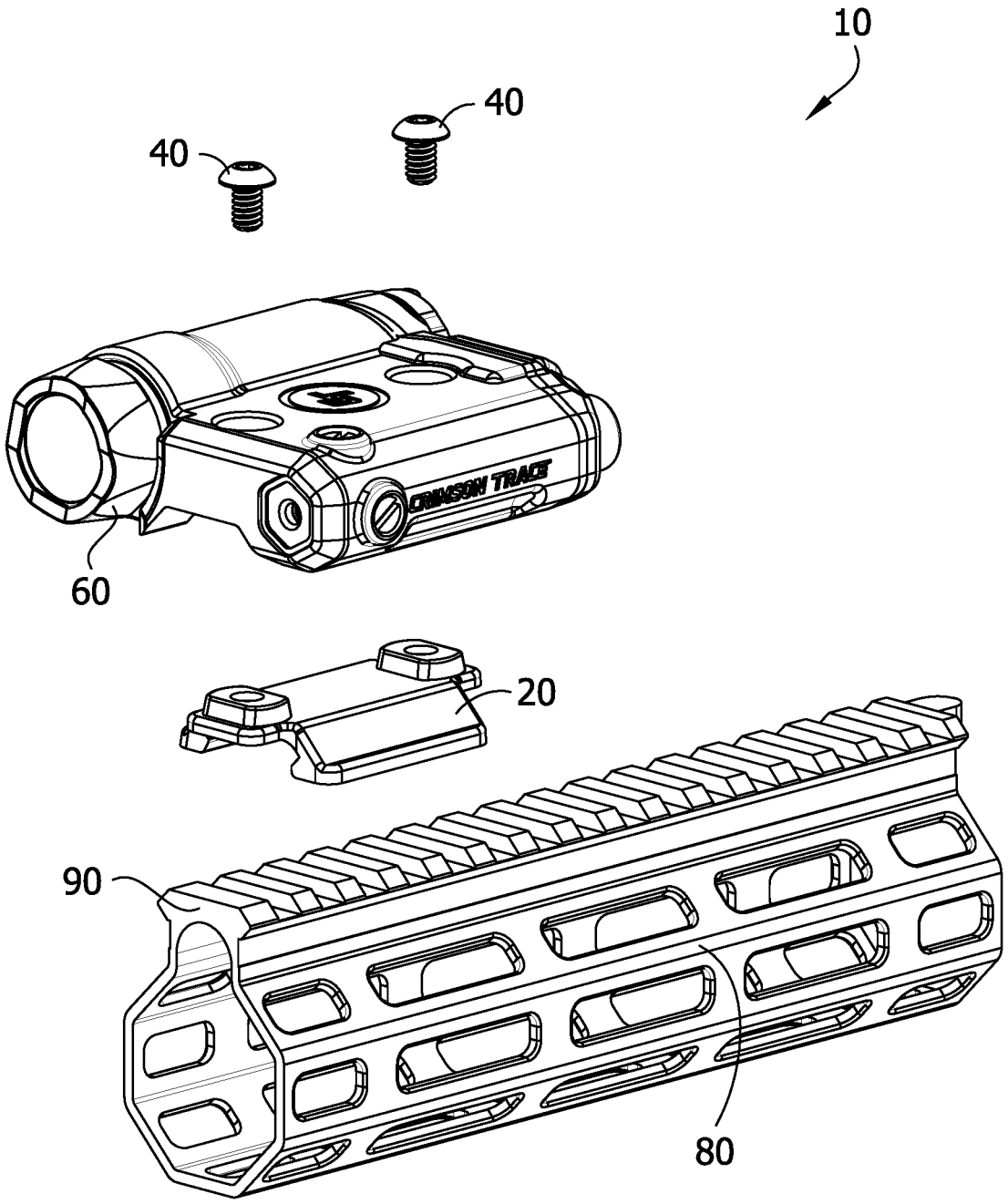
FIG. 3 is a top front perspective of a low profile rail mounting system, an accessory, and a Picatinny® rail.

Turning to FIG. 3, the relative positions of the adaptor 20, the fasteners 40, an accessory 60, in this case a laser sight, and a Picatinny® rail 90 situated on a hand guard 80 are depicted prior to assembly. As shown, the adaptor 20 snaps over the Picatinny® rail 90, where it forms a snap fit and can be secured, along with the accessory 60, by the fasteners 40.

Figure 4:
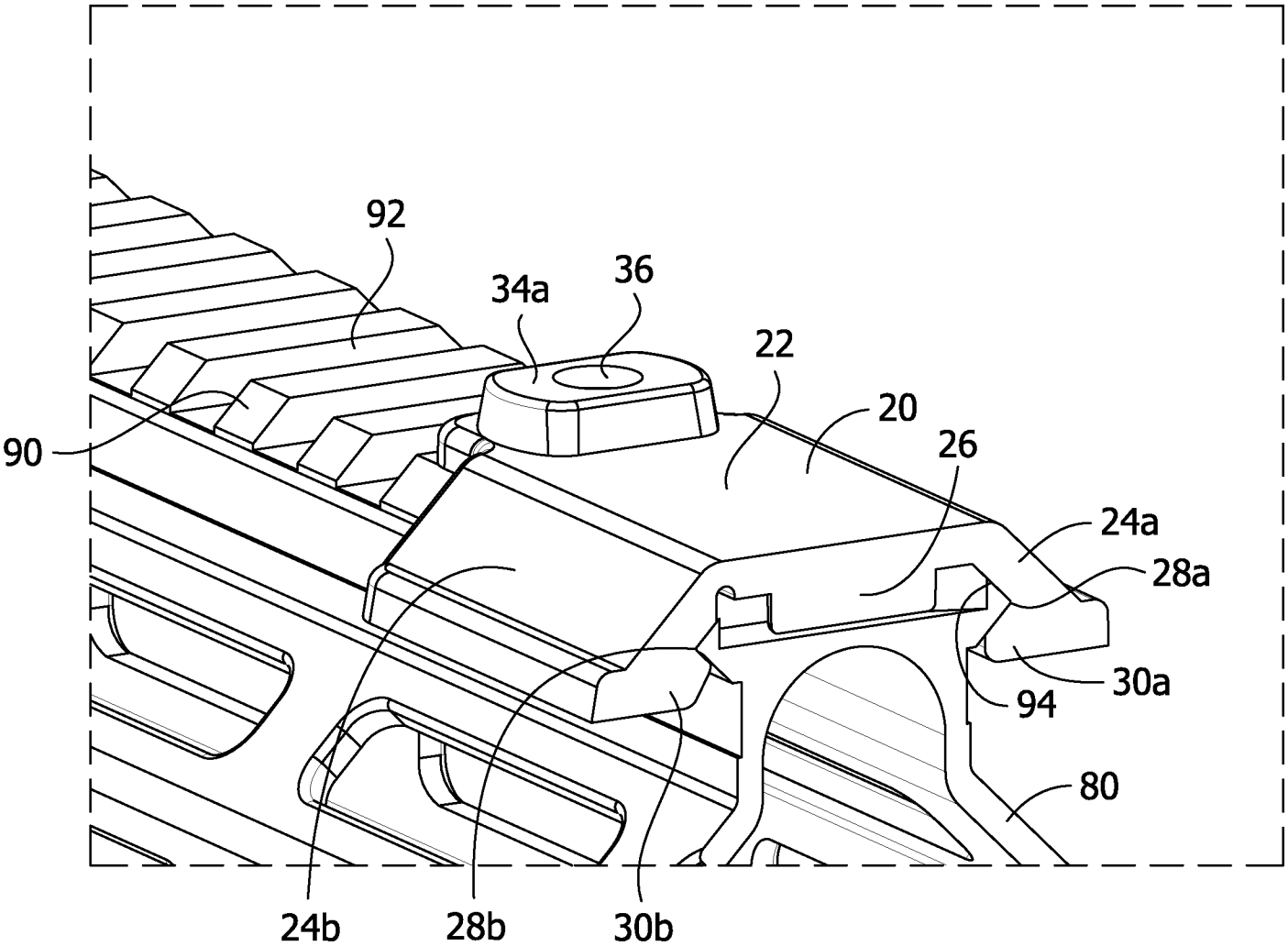
FIG. 4 is a cross-sectional top perspective of a low profile rail mounting system mounted to a Picatinny® rail.

Turing to FIG. 4, a cross-sectional top perspective of the adaptor 20 mounted to a Picatinny® rail 90 is shown to illustrate how the adaptor 20 couples to the Picatinny® rail 90. As seen in FIG. 4, the first groove 28*a* and the second groove 28*b* dove tail to the protruding sides 94*a* and 94*b* of the Picatinny® rail 90. As the adaptor 20 snaps over the Picatinny® rail 90, the first groove 28*a* and the second groove 28*b* act together to secure the adaptor 20 in place, for example as a snap- or pinch-fit, on the Picatinny® rail 90. Also, as seen in FIG. 4, the alignment bosses 26 on the bottom surface of the upper section 22 protrude into the cross slots 92 of the Picatinny® rail 90. This nesting of the alignment bosses 26 within the cross slots 92 limits the adaptor 20 from moving axially along the Picatinny® rail 90.

Figure 5:
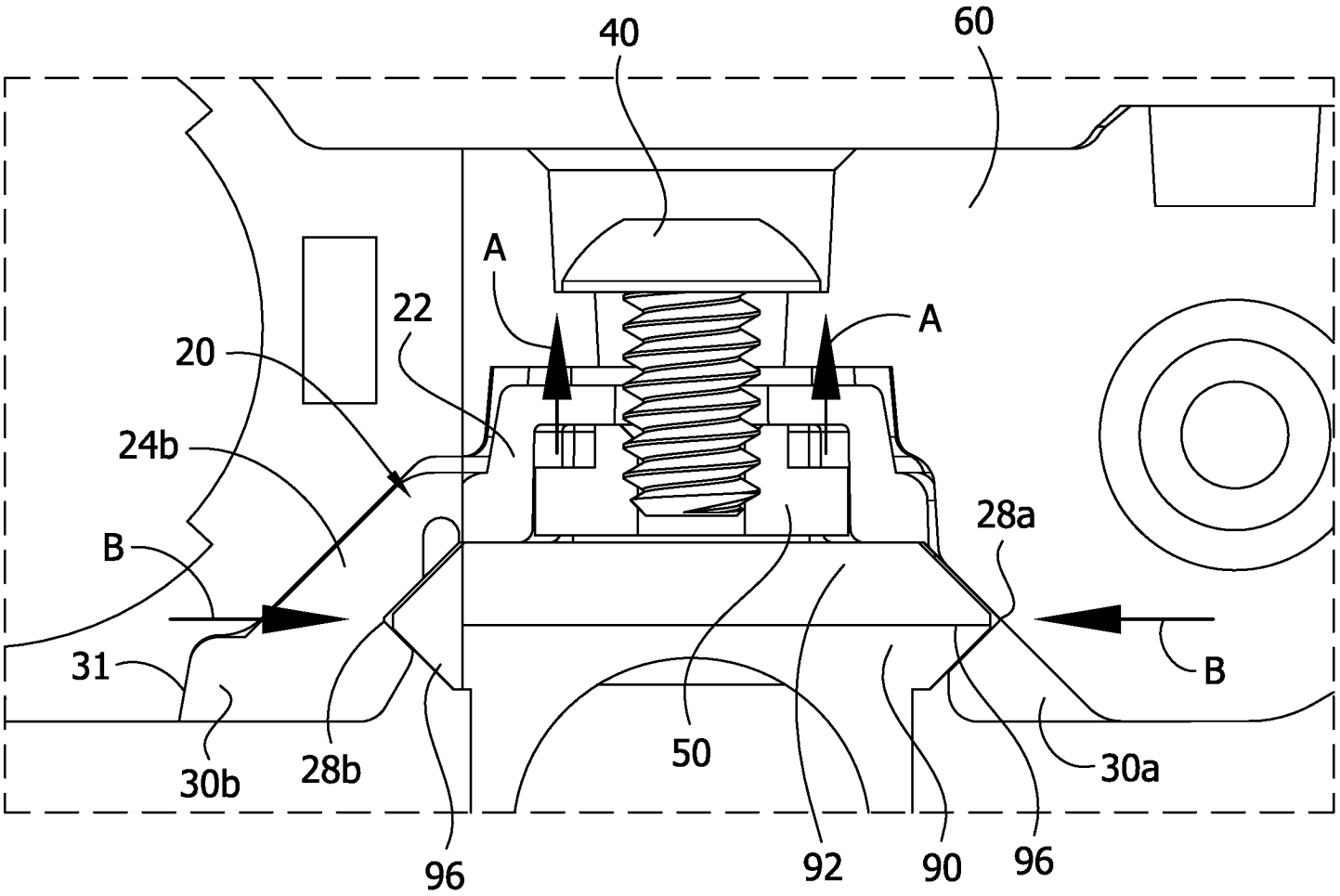
FIG. 5 is a cross-sectional view of a low profile rail mounting system and accessory mounted to a Picatinny® rail.

Turning to FIG. 5, a cross-sectional view of the adaptor 20 and an accessory 60 is shown mounted to a Picatinny® rail 90 system with fasteners 40 and t-nuts 50. This view shows how the components of the low profile rail mount system work together to secure the adaptor 20 and the accessory 60 to the Picatinny® rail 90. As the t-nut 50 is drawn up (see arrows A) by tightening of the fasteners 40, the accessory 60 is drawn down, relative to the adaptor 20. As the accessory 60 is drawn down, it pushes on taper 31 of the first foot section 30*a* and the second foot section 30*b* causing the first wing section 24*a* and the second wing section 24*b* to clamp to the Picatinny® rail 90 with the first groove 28*a* and the second groove 28*b*. This interference taper fit between the adapter 20 and the accessory 60 is such that when the fasteners 40 are torqued in place, the grooves 28*a* and 28*b* on the adapter 20 are biased inward (see arrows B) providing lateral clamping force between the adaptor 20 (and thus the accessory 60) and the Picatinny® rail 90.

Figure 6A:
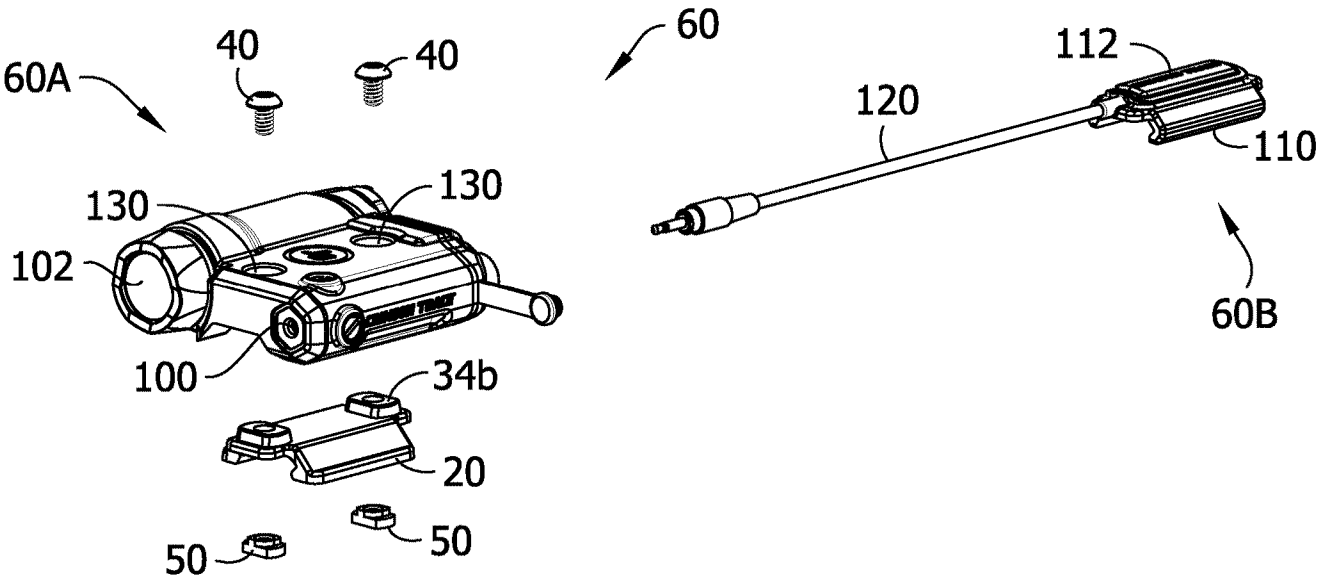
FIGS. 6A-6C show a laser sight accessory and a low profile rail mounting system.
Figure 6B:
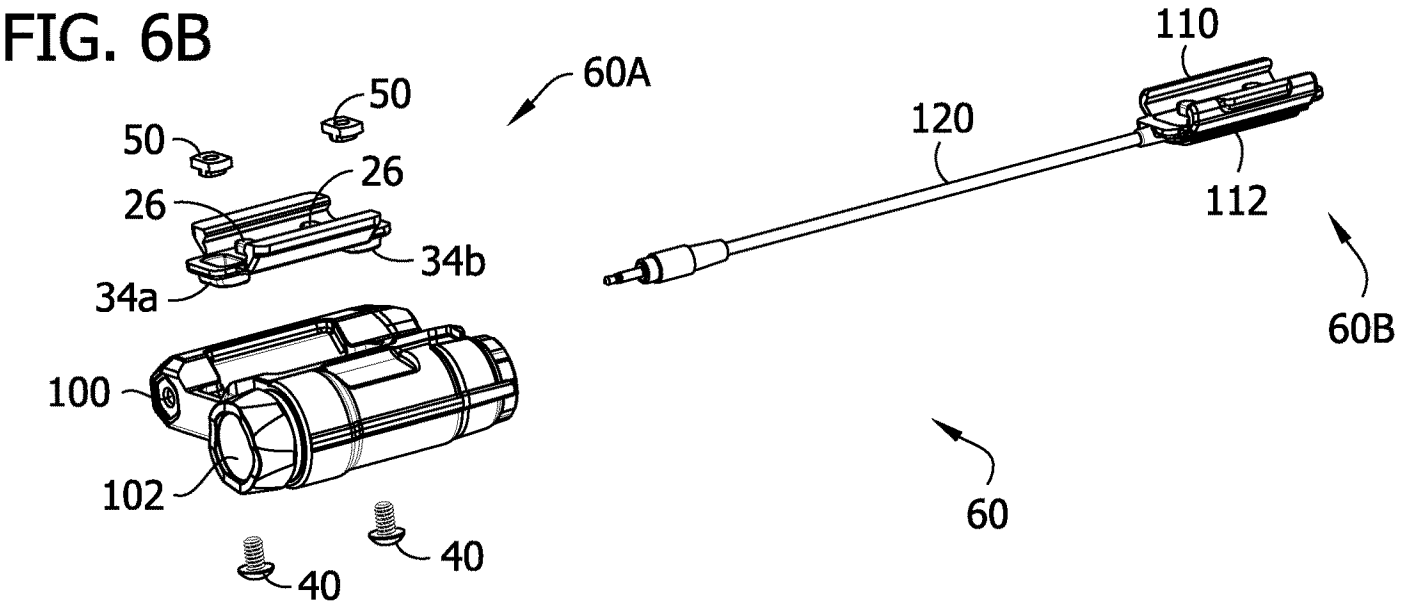
Figure 6C:
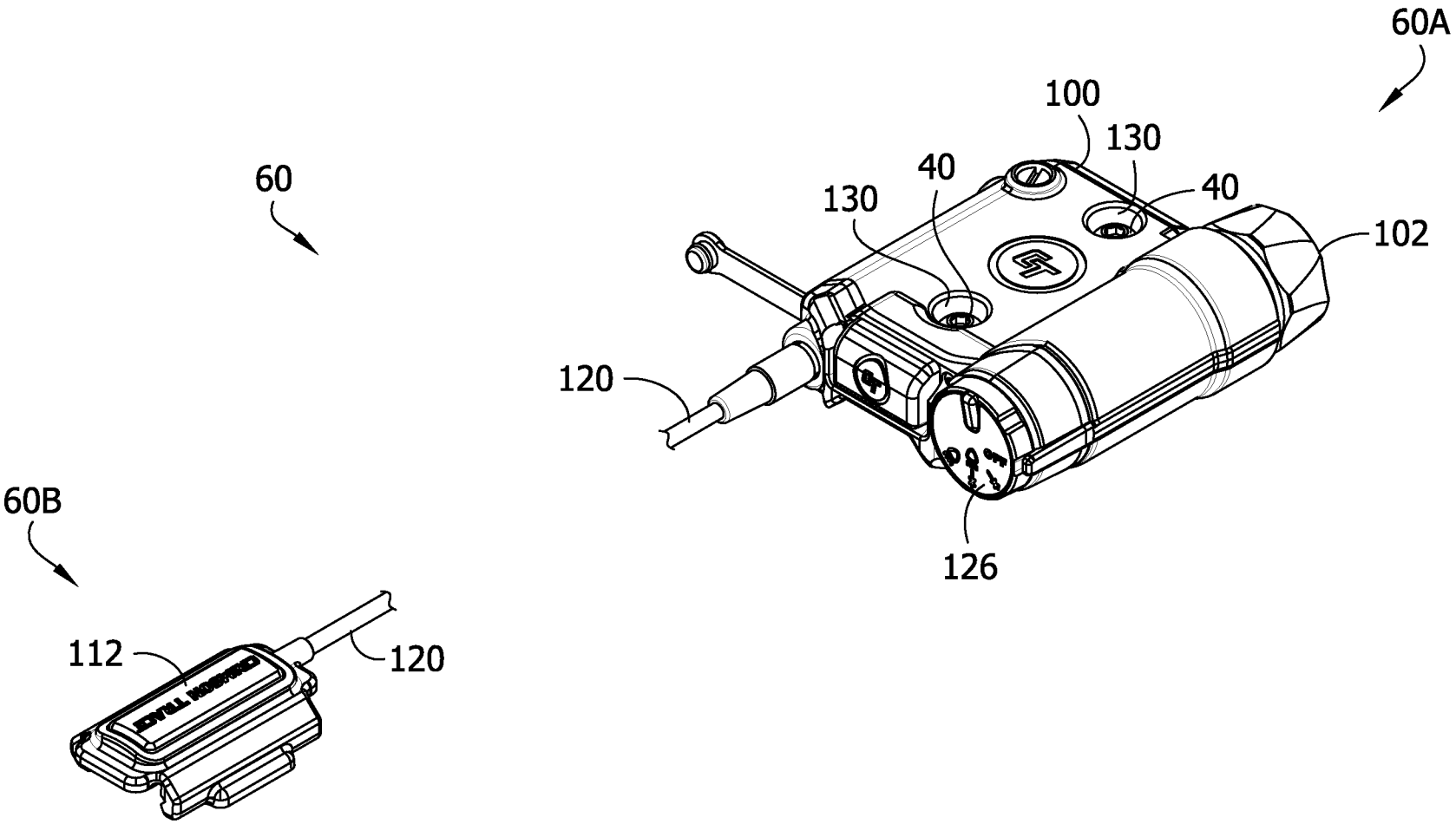

FIGS. 6A-6C illustrate an accessory system 60 and the low profile rail mounting system 10. In the illustrated embodiment, the accessory system 60 includes an accessory 60A and an associated remote switch 60B. For example, the accessory 60A can include a laser 100 (broadly, "sight") and/or a light 102. In the illustrated embodiment, the accessory 60A includes a laser 100 and a light 102 with a shared housing that is mountable to a firearm rail using the adaptor 20. The remote switch 60B includes a mount 110 having a similar construction as the adaptor 20 (e.g., wings, feet, flexible material) enabling the remote switch to be mounted to the firearm rail system (e.g., on same or different rail as the accessory 60A) in a similar snap-on manner. The remote switch 60B includes an actuator 112 (e.g., push-button switch and/or momentary switch) for actuating the accessory 60A (e.g., on, off, different modes, etc.). The remote switch 60B can be tethered to the accessory by connecting a tether 120 to the accessory 60A (e.g., plugging a male connector into a port on the accessory). In some circumstances, the remote switch 60B may not be used. Whether the remote switch is used or not, the accessory 60A can be actuated using one or more actuators (e.g., rotary dial 126) on the accessory. It will be appreciated that the light 102 and laser 100 are provided in a side-by-side arrangement to provide a low profile fit on the firearm. The housing of the accessory 60A straddles the adaptor 20, with the light 102 and laser 100 on opposite sides of the adaptor. The housing of the accessory 60A includes a portion between the light 102 and laser 100 to which the adaptor is connected via the fasteners 40. In particular, the intermediate portion of the housing includes openings 130 through which the fasteners 40 extend. The risers 34*a*, 34*b* of the adaptor 20 are received in a recess on the bottom of the accessory 60A. The arrangement is such that the light 102 and laser 100 are positioned to opposite sides of the rail and/or straddle the rail to which the adaptor 20 is mounted. To install the accessory 60A on the rail, the accessory and adaptor 20 can be loosely connected by the fasteners 40. Then the adaptor 20 is snapped onto the rail, and the fasteners 40 are tightened to draw the nuts 50 toward the adaptor. The tightened fasteners 40, the clamping of the adaptor 20 on the rail, and the bosses 34*a*, 34*b* in the rail, serve to secure the adaptor and thus the accessory in position on the rail.

It will be apparent that modifications and variations are possible without departing from the scope of the invention defined in the appended claims.

As various changes could be made in the above constructions and methods without departing from the scope of the invention, it is intended that all matter contained in the above description and shown in the accompanying drawings shall be interpreted as illustrative and not in a limiting sense.

What is claimed is:

1. A low profile firearm accessory rail mounting system for mounting a firearm accessory on a firearm rail, the system comprising:

an adaptor mountable on the firearm rail, the adaptor comprising:

an upper adaptor section;

at least one alignment boss configured to be received in a slot of the firearm rail, the at least one alignment boss extending downwardly from the upper adaptor section;

a first wing section and a second wing section extending distally from respective opposite sides of the upper adaptor section and configured to extend over the firearm rail when the adapter is mounted on the firearm rail;

a first foot section supported by the first wing section, a second foot section supported by the second wing section, wherein the first foot section and first wing section form a first groove and the second foot section and second wing section form a second groove, the first and second grooves configured to receive the firearm rail to mount the adaptor to the firearm rail;

wherein the adapter comprises flexible material configured to permit the first foot section and the second foot section to snap the adaptor onto the firearm rail with the firearm rail received in the grooves;

the upper adapter section having a top surface and at least one riser projecting upwardly from the top surface, the riser having an opening;

a fastener sized and shaped to be received through the opening in the riser to connect an accessory to the upper adapter section.

2. The system of claim 1, wherein the adapter further comprises a taper on the first foot section, the taper being positioned to engage a firearm accessory when secured to the adaptor by the fastener.

3. The system of claim 2, wherein the taper is shaped and arranged on the adapter to drive the first foot section toward the section foot section upon securement of the firearm accessory to the adaptor by the fastener to further secure the adaptor to the firearm rail when mounted.

4. The system of claim 3, further comprising at least one t-nut configured to secure the one or more fasteners.

5. The system of claim 1, wherein the adaptor is configured to protrude less than ½ inch from a surface of the firearm rail when the adaptor is mounted on the firearm rail.

6. The system of claim 1, wherein the riser constitutes a first riser, the adaptor further a second riser on the top surface of the upper adaptor section.

7. The system of claim 1, wherein the adaptor is configured to provide an interference fit between the adapter and firearm accessory such that when the adaptor is mounted on the firearm rail, the first groove and the second groove are biased inward to provide lateral clamping force on the firearm rail.

8. The system of claim 1, further comprising a firearm accessory connectable to the adaptor.

9. The system of claim 8, wherein the firearm accessory comprises a laser site.

10. The system of claim 1, in combination with the firearm rail.

11. The system of claim 1, wherein the firearm rail comprises a Picatinny rail.

12. The system of claim 1, wherein each groove comprises a v-groove.

13. The system of claim 1, wherein the adapter is configured to snap onto a dovetail rail.

14. The system of claim 1, wherein the upper adaptor section, the first wing section, the second wing section, the first foot section, and the second foot section are integrally formed as a unitary piece of material.

15. The system of claim 1, wherein the alignment boss is fixed in position with respect to the upper adaptor section.

16. The system of claim 1, wherein the upper adaptor section and the alignment boss are integrally formed as a unitary piece of material.

* * * * *